US011434701B2

(12) United States Patent
Flander et al.

(10) Patent No.: US 11,434,701 B2
(45) Date of Patent: Sep. 6, 2022

(54) MULTI-DIAMETER THRUST CUPS

(71) Applicant: Schlumberger Technology Corporation, Sugar Land, TX (US)

(72) Inventors: Simon Mattias Flander, Houston, TX (US); Julien Toniolo, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 17/101,965

(22) Filed: Nov. 23, 2020

(65) Prior Publication Data

US 2022/0162917 A1 May 26, 2022

(51) Int. Cl.
*E21B 17/10* (2006.01)
*E21B 33/12* (2006.01)

(52) U.S. Cl.
CPC ..... *E21B 17/1028* (2013.01); *E21B 33/1208* (2013.01); *E21B 2200/01* (2020.05)

(58) Field of Classification Search
CPC ..... E21B 17/1021; E21B 17/1028; E21B 17/1042; E21B 23/0413
See application file for complete search history.

(56) References Cited

U.S. PATENT DOCUMENTS 2,117,538 A 5/1938 Baker
3,266,386 A 8/1966 Scaramucci
3,358,768 A 12/1967 Solum
3,487,753 A 1/1970 Read
3,724,337 A 4/1973 Richardson
4,638,726 A 1/1987 Johnson et al.
4,787,458 A * 11/1988 Langer ..... E21B 17/1028 166/380
6,381,797 B1 5/2002 Filippovitch et al.
7,025,142 B2 4/2006 Crawford
8,011,052 B2 9/2011 Kapustin et al.
2014/0116724 A1 5/2014 McDougall et al.
(Continued)

FOREIGN PATENT DOCUMENTS

CN 110998059 A 4/2020
WO 2006001707 A1 1/2006
(Continued)

OTHER PUBLICATIONS

"VariPig" accessed Jan. 12, 2021 at [https://www.ftl.technology/products/varipig], 2021, 9 pages.
(Continued)

*Primary Examiner* — David Carroll
(74) *Attorney, Agent, or Firm* — Trevor G. Grove

(57) ABSTRACT

Embodiments described herein provide a multi-diameter thrust device that includes one or more thrust cups. Each thrust cup of the one or more thrust cups includes a first axial end hub disposed at a first axial end of the thrust cup; a second axial end hub disposed at a second axial end of the thrust cup; and a plurality of bowsprings. Each bowspring of the plurality of bowsprings includes a first axial end portion coupled to the first axial end hub and a second axial end portion coupled to the second axial end hub. The plurality of bowsprings are disposed circumferentially about a central axis of the multi-diameter thrust device.

18 Claims, 12 Drawing Sheets

(56) References Cited

U.S. PATENT DOCUMENTS

| | | | | |
|---|---|---|---|---|
| 2015/0226019 | A1* | 8/2015 | Umphries | E21B 17/1028 166/382 |
| 2016/0047209 | A1* | 2/2016 | Castillo | E21B 23/08 166/386 |
| 2020/0123859 | A1* | 4/2020 | Sivils | E21B 47/00 |

FOREIGN PATENT DOCUMENTS

| | | | |
|---|---|---|---|
| WO | 2008081402 | A1 | 7/2008 |
| WO | 2012125660 | A2 | 9/2012 |
| WO | 2016028565 | A1 | 2/2016 |
| WO | 2017200513 | A1 | 11/2017 |

OTHER PUBLICATIONS

International Search Report and Written Opinion of the PCT Application PCT/US2021/060527 dated Mar. 17, 2022, 11 pages.

* cited by examiner

MULTI-DIAMETER THRUST CUPS

BACKGROUND

The present disclosure generally relates to systems and methods for multi-diameter thrust devices that include one or more multi-diameter thrust cups configured to provide thrust to push the multi-diameter thrust device, and an associated downhole tool, through a conduit, such as drill pipe.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as an admission of any kind.

In the area of downhole tool conveyance, traditional methods include tethering the downhole tool to wireline or slickline cables, or to rigid pipe such as coiled tubing or segmented drill pipe. In the case of wireline or slickline conveyance in non-vertical wells, due the flexible nature of the wireline or slickline, it may become difficult to push the downhole tool along a horizontal or toe-up hole. If the downhole tool is conveyed through pipe that has an annular return path to the surface (such as a wireline logging tool conveyed through drill pipe), this limitation can be overcome by pumping fluid into the drill pipe to push the downhole tool along the non-vertical section of the well, taking advantage of fluid drag to propel the downhole tool forward. However, one limitation of this method is that, in cases where the inner diameter (ID) of the drill pipe is significantly larger than the outer diameter (OD) of the downhole tool, the fluid drag may not be sufficient to propel the downhole tool forward because the viscous loss is too limited given the large annular cross section between the ID of drill pipe and the OD of the downhole tool.

SUMMARY

A summary of certain embodiments described herein is set forth below. It should be understood that these aspects are presented merely to provide the reader with a brief summary of these certain embodiments and that these aspects are not intended to limit the scope of this disclosure.

Certain embodiments of the present disclosure include a multi-diameter thrust device that includes one or more thrust cups. Each thrust cup of the one or more thrust cups includes a first axial end hub disposed at a first axial end of the thrust cup, wherein the first axial end of the thrust cup is configured to receive a flow of fluid; a second axial end hub disposed at a second axial end of the thrust cup, wherein the second axial end of the thrust cup is configured to at least partially block the fluid from flowing axially past the second axial end of the thrust cup; and a plurality of bowsprings. Each bowspring of the plurality of bowsprings includes a first axial end portion coupled to the first axial end hub and a second axial end portion coupled to the second axial end hub. The plurality of bowsprings are disposed circumferentially about a central axis of the multi-diameter thrust device.

Other embodiments of the present disclosure include a multi-diameter thrust device that includes a mandrel configured to be used as a housing or a flow line; and one or more thrust cups secured to the mandrel radially about the mandrel. Each thrust cup of the one or more thrust cups includes a first axial end hub disposed at a first axial end of the thrust cup, wherein the first axial end hub is configured to slide axially relative to the mandrel; a second axial end hub secured to the mandrel at a second axial end of the thrust cup; and a plurality of bowsprings configured to collapse radially. Each bowspring of the plurality of bowsprings includes a first axial end portion coupled to the first axial end hub and a second axial end portion coupled to the second axial end hub. The plurality of bowsprings are disposed circumferentially about a central axis of the multi-diameter thrust device. In addition, each bowspring of the plurality of bowsprings includes a first main bowspring portion extending axially from the first axial end portion of the bowspring. The first main bowspring portion includes a slot extending therethrough axially along the first main bowspring portion. Each bowspring of the plurality of bowsprings also includes a second main bowspring portion extending axially from the second axial end portion of the bowspring. The first and second main bowspring portions meet at an intermediate axial location along the multi-diameter thrust device. The second main bowspring portion does not include a slot extending therethrough. In addition, each thrust cup of the one or more thrust cups is configured to receive a flow of fluid at the first axial end of the thrust cup, and to at least partially block the fluid from flowing axially past the second axial of the thrust cup.

Other embodiments of the present disclosure include a multi-diameter thrust device that includes a mandrel configured to be used as a housing or a flow line; and one or more thrust cups secured to the mandrel radially about the mandrel. Each thrust cup of the one or more thrust cups includes a first axial end hub disposed at a first axial end of the thrust cup, wherein the first axial end hub is configured to slide axially relative to the mandrel; a second axial end hub secured to the mandrel at a second axial end of the thrust cup; and a plurality of bowsprings configured to collapse radially. Each bowspring of the plurality of bowsprings includes a first axial end portion coupled to the first axial end hub and a second axial end portion coupled to the second axial end hub. The plurality of bowsprings are disposed circumferentially about a central axis of the multi-diameter thrust device. Each bowspring of the plurality of bowsprings includes a first main bowspring portion extending axially from the first axial end portion of the bowspring. The first main bowspring portion is configured to be spaced circumferentially relative to first main bowspring portions of adjacent bowsprings of the plurality of bowsprings. Each bowspring of the plurality of bowsprings also includes a second main bowspring portion extending axially from the second axial end portion of the bowspring. The first and second main bowspring portions meet at an intermediate axial location along the multi-diameter thrust device. The second main bowspring portion is associated with a plurality of discrete asymmetrical curved fingers extending radially from the second main bowspring portion and at least partially disposed radially within the second main bowspring portion of a neighboring bowspring adjacent each other along the axial length of the second main bowspring portion. In addition, each thrust cup of the one or more thrust cups is configured to receive a flow of fluid at the first axial end of the thrust cup, and to at least partially block the fluid from flowing axially past the second axial of the thrust cup.

Various refinements of the features noted above may be undertaken in relation to various aspects of the present disclosure. Further features may also be incorporated in these various aspects as well. These refinements and additional features may exist individually or in any combination.

For instance, various features discussed below in relation to one or more of the illustrated embodiments may be incorporated into any of the above-described aspects of the present disclosure alone or in any combination. The brief summary presented above is intended to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings, in which.

DETAILED DESCRIPTION

One or more specific embodiments of the present disclosure will be described below. These described embodiments are only examples of the presently disclosed techniques. Additionally, to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

As used herein, the terms "connect," "connection," "connected," "in connection with," and "connecting" are used to mean "in direct connection with" or "in connection with via one or more elements"; and the term "set" is used to mean "one element" or "more than one element." Further, the terms "couple," "coupling," "coupled," "coupled together," and "coupled with" are used to mean "directly coupled together" or "coupled together via one or more elements." As used herein, the terms "up" and "down," "uphole" and "downhole," "upper" and "lower," "top" and "bottom," and other like terms indicating relative positions to a given point or element are utilized to more clearly describe some elements. Commonly, these terms relate to a reference point as the surface from which drilling operations are initiated as being the top (e.g., uphole or upper) point and the total depth along the drilling axis being the lowest (e.g., downhole or lower) point, whether the well (e.g., wellbore, borehole) is vertical, horizontal or slanted relative to the surface.

Figure 1A:
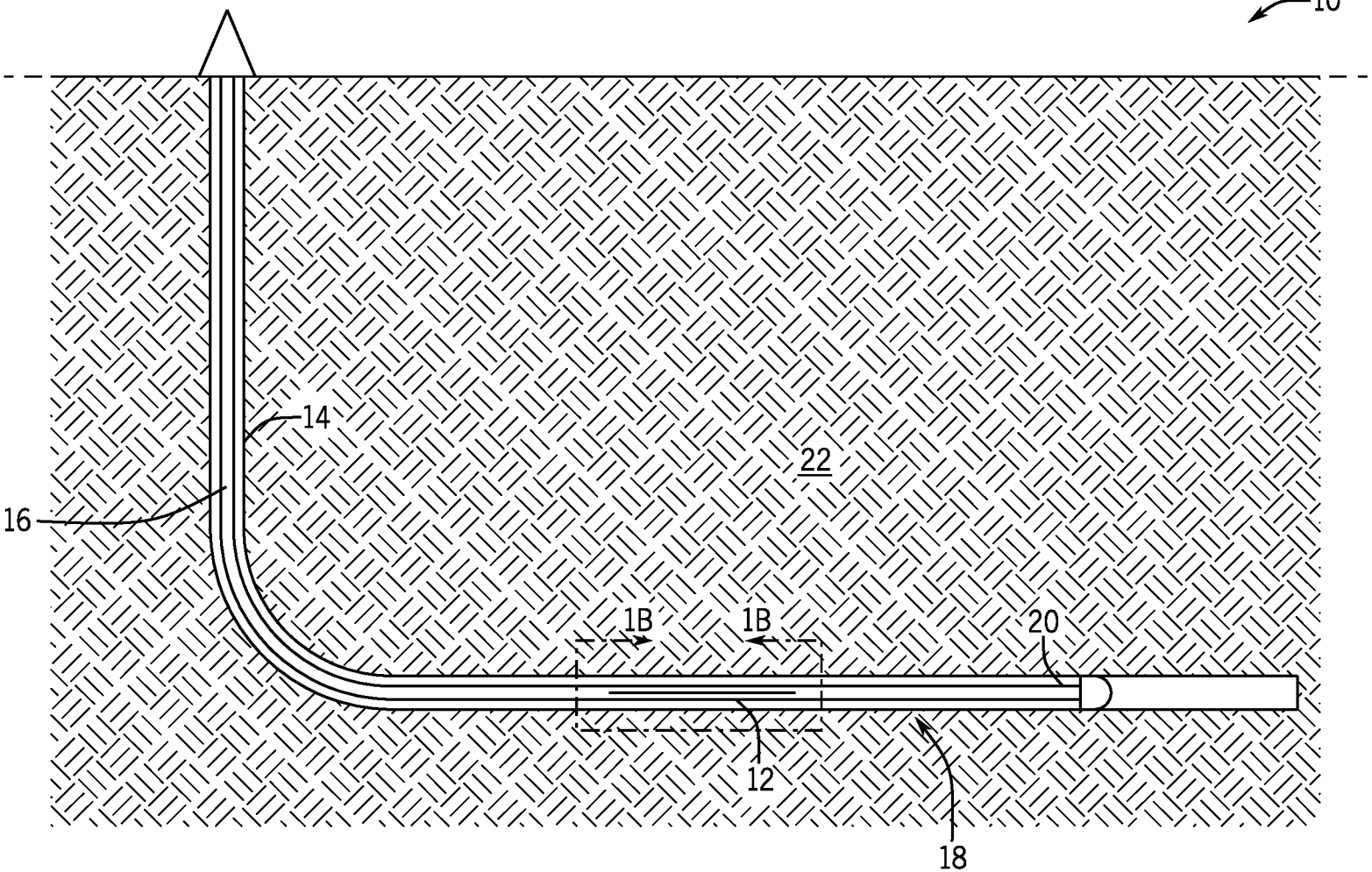
FIGS. 1A and 1B illustrate a well within which a downhole tool (e.g., such as a logging tool) is conveyed down into a wellbore via pump down conveyance methods, in accordance with embodiments of the present disclosure.
Figure 1B:
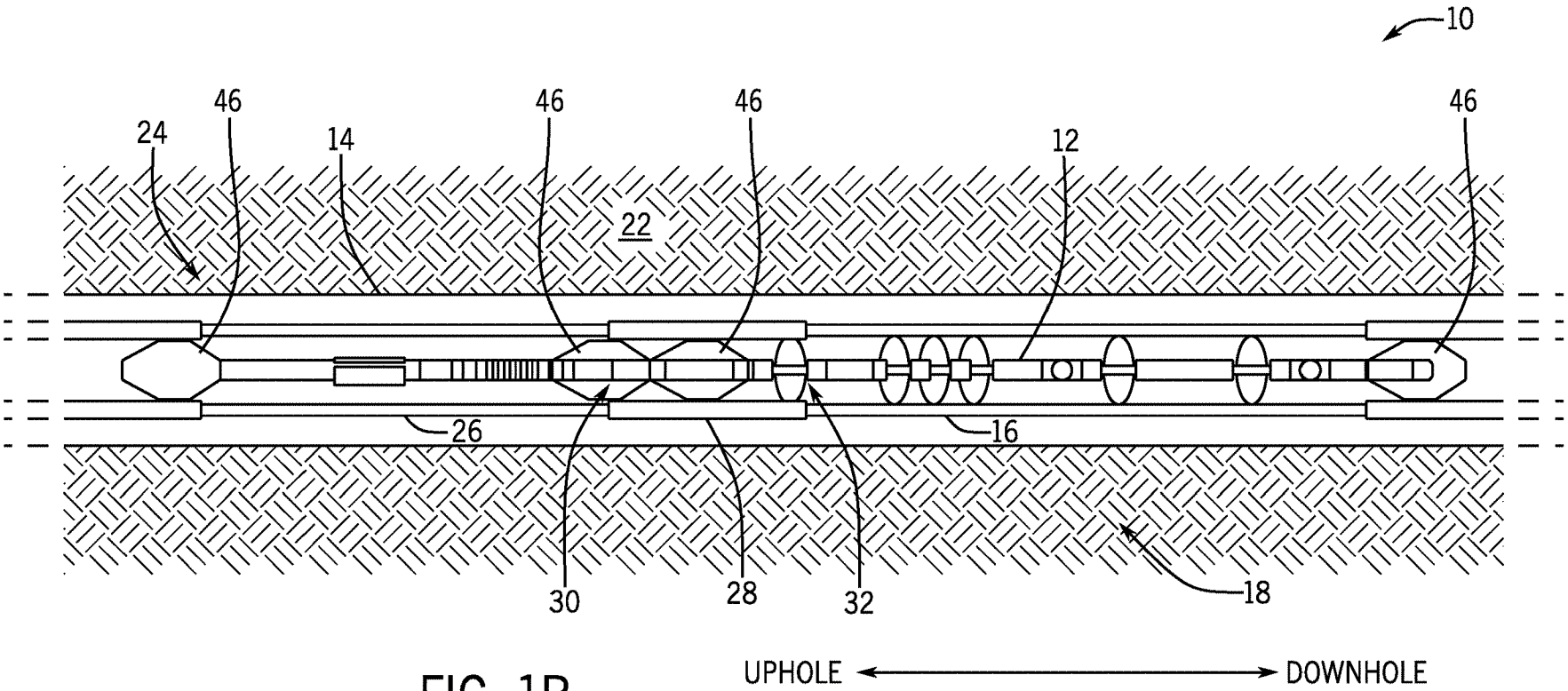

FIGS. 1A and 1B illustrate a well 10 within which a downhole tool 12 (e.g., such as a logging tool) is conveyed down into a wellbore 14 via pump down conveyance methods whereby, for example, a fluid flowing through drill pipe 16 is used to provide the motive force to drive the downhole tool 12 through the wellbore 14, as described in greater detail herein, particularly in non-vertical sections 18 of the wellbore 14. As illustrated in FIG. 1A, in certain embodiments, a reaming bottom hole assembly (BHA) 20 may be used to form the wellbore 14 through a subterranean formation 22.

As described above, conventional methods of conveying downhole tools 12 through non-vertical sections 18 of wells 10 by pumping fluid into drill pipe 16 to push the downhole tools 12 along the non-vertical sections 18 of the wells 10 may be limited where fluid drag is not sufficient to propel the downhole tools 12 forward in situations where the inner diameter (ID) of the drill pipe 16 is significantly larger than the outer diameter (OD) of the downhole tools 12. One possible solution to this situation is to increase the OD of some part of the downhole tool 12 to minimize the annular gap between the downhole tool 12 and the drill pipe 16. However, this solution may not be possible in cases where the sections of drill pipe 16 do not have the same ID throughout the entire drill string 24. For example, as illustrated in FIG. 1B, in certain situations, individual sections 24, 26 of drill pipe 16 may have several different IDs and crossovers in the same drill string 24, resulting in several restrictions 30 or expansions 32 in the ID of the drill pipe 16 until the downhole tool 12 reaches the end of the drill string 24. For example, in certain embodiments, the range of IDs for the drill pipe 16 through which the downhole tool 12 needs to pass may be on the order of 2⅜" to 4¹⁄₁₆". Moreover, in certain situations, knowing the exact ID for some drill strings 24 may be complex from an operational point of view.

It should be noted that the scenario illustrated in FIGS. 1A and 1B is merely exemplary of the types of situations where downhole tools 12 are conveyed into wells 10 and that may benefit from embodiments of the present disclosure. However, other situations whereby other tools (e.g., other than downhole tools 12) are conveyed through other types of conduits (e.g., other than wellbores 14) may also benefit from embodiments of the present disclosure. For example, similar problems may exist with pipeline pigging where a "pig" is pumped through a pipeline having multiple IDs.

Figure 2:
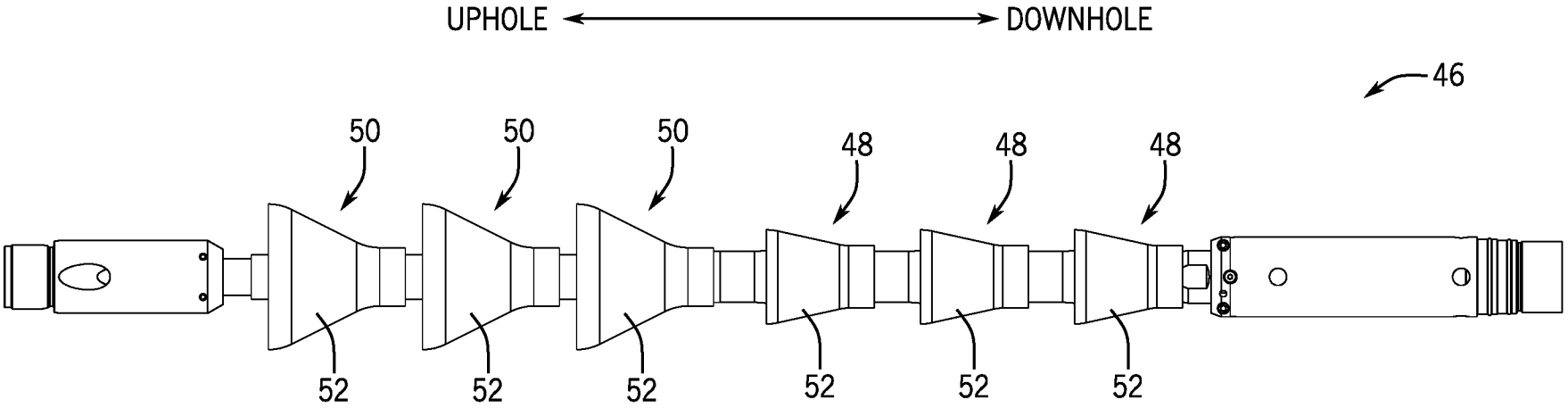
FIG. 2 illustrates an embodiment of a multi-diameter thrust device having a plurality of thrust elements spaced axially along the multi-diameter thrust device, in accordance with embodiments of the present disclosure.

As described in greater detail herein, one or more multi-diameter thrust devices 46 may be used to provide thrust to convey the downhole tool 12 through the wellbore 14, particularly in non-vertical sections of the wellbore 14. FIG. 2 illustrates an embodiment of the multi-diameter thrust device 46 having a plurality of thrust elements 48, 50 spaced axially along the multi-diameter thrust device 46. As illustrated, in certain embodiments, the plurality of thrust elements 48, 50 may include a first set of thrust elements 48 having a first OD and a second set of thrust elements 50 having a second, larger OD. In operation, the differing ODs of the thrust elements 48, 50 enables the multi-diameter thrust device 46 to provide thrust for the multi-diameter thrust device 46 though conduits (e.g., drill pipe 16) having differing IDs. In general, the larger diameter flexible thrust elements 50 are designed to collapse when they encounter an ID restriction in a conduit (e.g., drill pipe 16), allowing fluid to leak past them and engage smaller diameter thrust elements 48 instead.

In certain embodiments, cups 52 (e.g., flexible polyurethane "swab cups" or "butterfly disks") of various diameters may be used as the thrust elements 48, 50. In certain embodiments, the cups 52 of the thrust elements 48, 50 may be made from hydrogenated acrylonitrile butadiene rubber (HNBR). It has been found that polyurethane does not provide desirable results in relatively high temperature downhole environments. In addition, it has been found that balancing the need for flexibility with sufficient strength to avoid tearing the rubber of the thrust elements 48, 50 may prove challenging. Furthermore, designing the shape of the cups 52 of the thrust elements 48, 50 may present a problem if the downhole tool 12 needs to be fished (e.g., pulled out backwards uphole) out of the drill pipe 16, in which case the cups 52 may tear, leaving behind debris in the wellbore 14 or even resulting in the downhole tool 12 getting stuck within the wellbore 14.

Figure 3:
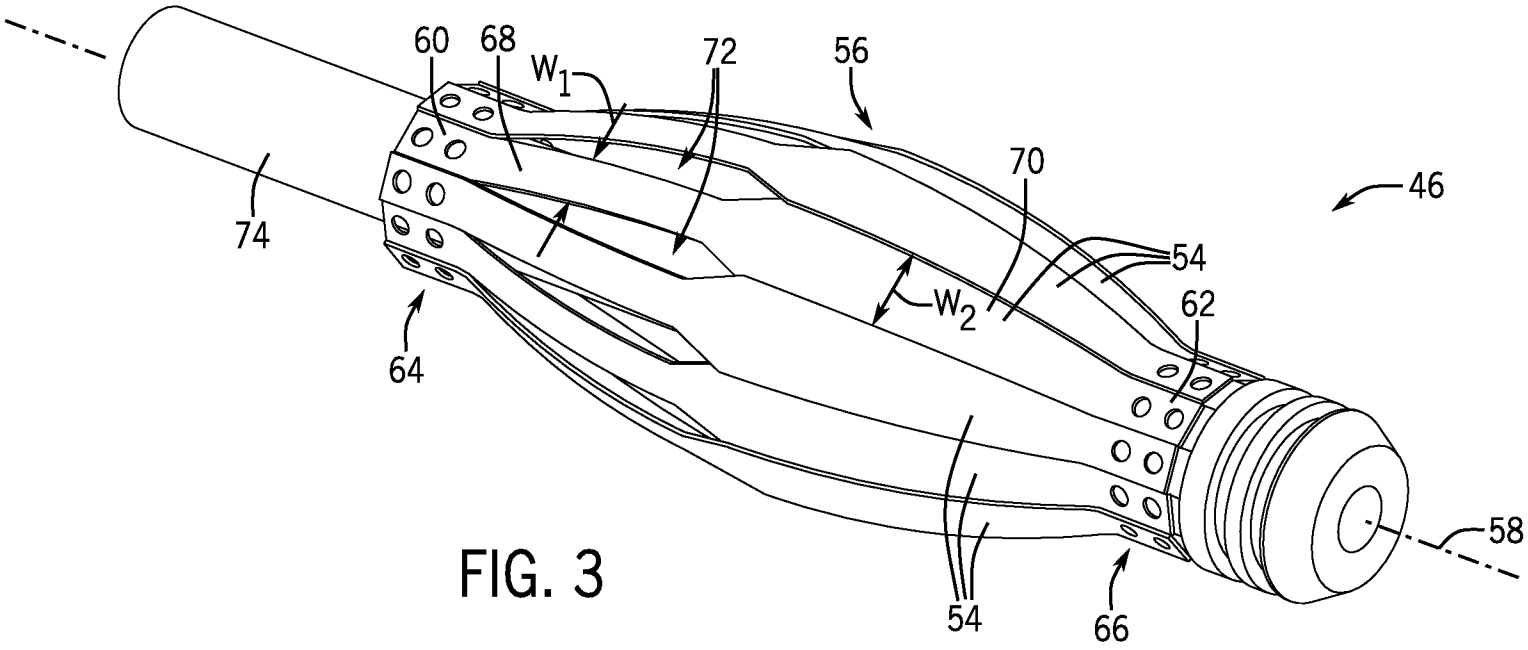
FIG. 3 is a perspective view of another embodiment of the multi-diameter thrust device in an expanded state, in accordance with embodiments of the present disclosure.

FIG. 3 is a perspective view of another embodiment of the multi-diameter thrust device 46. In the illustrated embodiment, the multi-diameter thrust device 46 includes a plurality of metal bowsprings 54 configured together to form a flexible metal thrust cup 56 when they are disposed (e.g., aligned) circumferentially about a central axis 58 of the multi-diameter thrust device 46. As used herein, the term "bowspring" is intended to mean a relatively thin (e.g., less than 10 millimeters, less than 5 millimeters, or even less), curved strip of a relatively flexible material (e.g., a metal, such as spring steel) that is substantially longer (e.g., over 10 times longer, or even more) than it is wide, and which is capable of being relatively straightened out (e.g., to reduce or even remove the curvature) for the purpose of facilitating the thrust cup 56 to adjust to the ID of a conduit (e.g., drill pipe 16) through which the multi-diameter thrust device 46 travels.

As described in greater detail herein, each bowspring 54 may include a first (e.g., upper or uphole) axial end portion 60 that is allowed to move (e.g., slide) axially with respect to the multi-diameter thrust device 46 and a second (e.g., lower or downhole) axial end portion 62 (e.g., at an opposite axial end of the bowspring 54) that is axially fixed in place with respect to the multi-diameter thrust device 46. As such, the bowsprings 54 may enable the multi-diameter thrust device 46 to receive a flow of fluid at an upper (e.g., uphole) axial end 64 of the multi-diameter thrust device 46, which may be blocked or at least partially blocked from flowing past a lower (e.g., downhole) axial end 66 of the multi-diameter thrust device 46 (e.g., when the fluid flows into an interior of the thrust cup 56) to generate thrust for the multi-diameter thrust device 46, as described in greater detail herein.

In addition, as illustrated in FIG. 3, in certain embodiments, the bowsprings 54 include a first (e.g., upper or uphole) main bowspring portion 68 extending from the first (e.g., upper or uphole) axial end portion 60 and a second (e.g., lower or downhole) main bowspring portion 70 extending from the second (e.g., lower or downhole) axial end portion 62 that meet at an intermediate axial location along the multi-diameter thrust device 46. As also illustrated in FIG. 3, in certain embodiments, the first main bowspring portions 68 of the bowsprings 54 are shaped such that they do not abut adjacent bowsprings 54 (e.g., are spaced circumferentially apart from adjacent bowsprings 54) when assembled together, whereas the second main bowspring portions 70 of the bowsprings 54 are shaped such that they do abut (e.g., make contact with) adjacent bowsprings 54 when assembled together. Specifically, as illustrated in FIG. 3, in certain embodiments, the first main bowspring portions 68 of the bowsprings 54 have a main width $w_1$ that is slightly smaller (e.g., less than 5% smaller, less than 10% smaller, less than 15% smaller, less than 20% smaller, less than 25% smaller, less than 30% smaller, less than 35% smaller, less than 40% smaller, and so forth) than a main width $w_2$ of the second main bowspring portions 70 of the bowsprings 54 such that circumferential openings 72 exist between adjacent first main bowspring portions 68 when assembled together, whereas adjacent second main bowspring portions 70 abut each other when assembled together. In addition, as also illustrated in FIG. 3, in certain embodiments, the first main bowspring portions 68 of the bowsprings 54 may include transition portions that transition from the main width $w_1$ of the first main bowspring portions 68 to the main width $w_2$ of the second main bowspring portions 70 of the bowsprings 54.

In addition, in the embodiment illustrated in FIG. 3, adjacent second main bowspring portions 70 of the bowsprings 54 have alternating mounting heights (e.g., relative to the central axis 58 of the multi-diameter thrust device 46) such that the second main bowspring portions 70 do not circumferentially interfere with each other. Rather, adjacent second main bowspring portions 70 of the bowsprings 54 overlap (or underlap) each other when compressed (e.g., collapsed) radially. For example, when the multi-diameter thrust device 46 illustrated in FIG. 3 travels into a portion of a conduit (e.g., drill pipe 16) having a smaller ID, the adjacent second main bowspring portions 70 of the bowsprings 54 move circumferentially relative to each other while still forming a relatively sealed OD while adjacent first main bowspring portions 68 of the bowsprings 54 still form circumferential openings 72 therebetween. Such an embodiment is relatively cheap and simple to manufacture and construct. However, at some point of radial compression, even adjacent first main bowspring portions 68 of the bowsprings 54 will begin to interfere with each other, as illustrated in FIG. 4.

Figure 4:
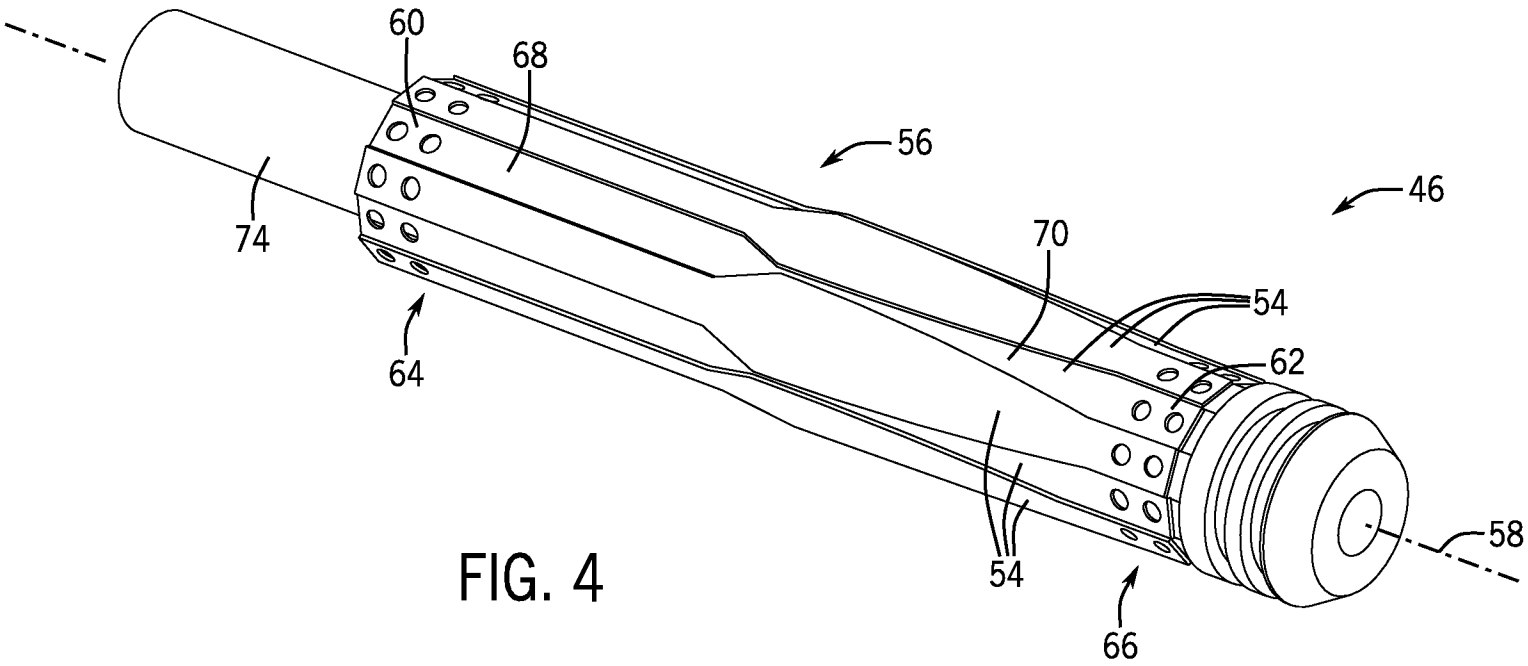
FIG. 4 is a perspective view of the multi-diameter thrust device of FIG. 3 in a collapsed state, in accordance with embodiments of the present disclosure.

The thrust cup 56 illustrated in FIGS. 3 and 4 are merely exemplary of one embodiment of a thrust cup configured to be secured to a mandrel 74 radially about the mandrel 74, wherein the thrust cup includes a plurality of metal bowsprings disposed circumferentially about a central axis 58 of the multi-diameter thrust device 46, and being configured to receive a flow of fluid at a first axial end of the thrust cup, to at least partially block the fluid from flowing axially past a second axial of the thrust cup, and to collapse radially to adjust to the ID of a conduit (e.g., drill pipe 16) through which the multi-diameter thrust device 46 travels. In certain embodiments, the mandrel 74 may be used as a housing (e.g., for cables, electronics, and so forth) or may be used as a flow line, for example, through which a fluid may flow.

Figure 5:
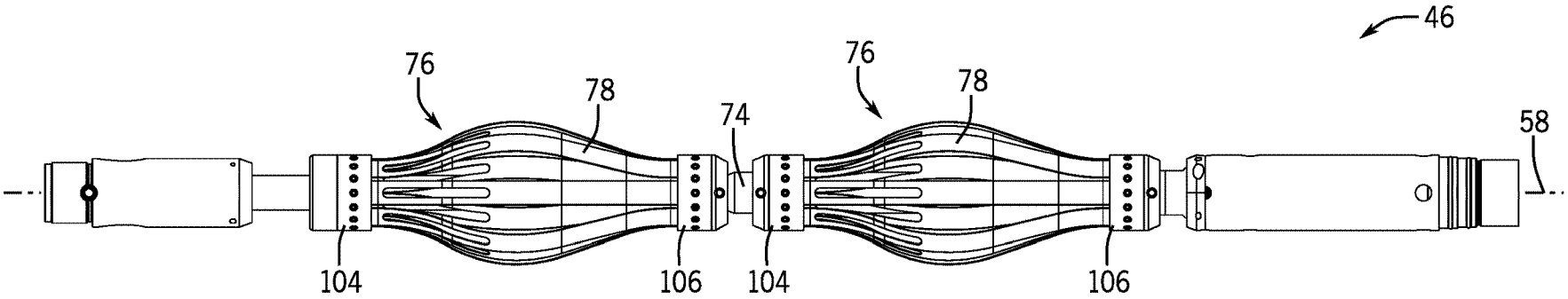
FIG. 5 is a side view of another embodiment of the multi-diameter thrust device, in accordance with embodiments of the present disclosure.
Figure 6:
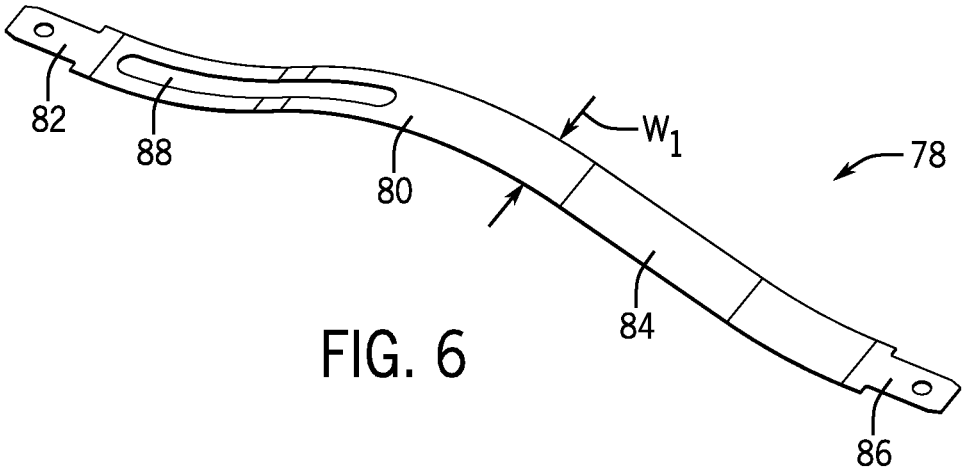
FIG. 6 is a perspective view of a bowspring of a thrust cup of the multi-diameter thrust device of FIG. 5, in accordance with embodiments of the present disclosure.

For example, FIG. 5 is a side view of another embodiment of the multi-diameter thrust device 46 that includes a plurality of flexible metal thrust cups 76 disposed in series axially along the multi-diameter thrust device 46, each thrust cup 76 having a plurality of metal bowsprings 78. As illustrated in FIG. 6, similar to the bowsprings 54 described above, each bowspring 78 includes a first (e.g., upper or uphole) main bowspring portion 80 extending from a first (e.g., upper or uphole) axial end portion 82 of the bowspring 78 and a second (e.g., lower or downhole) main bowspring portion 84 extending from a second (e.g., lower or downhole) axial end portion 86 of the bowspring 78 that meet at an intermediate axial location along the multi-diameter thrust device 46. As also illustrated in FIG. 6, all of the portions 80, 82, 84, 86 of each bowspring 78 include a substantially constant width $w_1$ (e.g., within manufacturing tolerances, such as having less than 1% variance in width) along the entire axial length of the bowspring 78.

In addition, as also illustrated in FIG. 6, the first (e.g., upper or uphole) main bowspring portion 80 of each bowspring 78 includes a slot 88 extending therethrough axially along the first (e.g., upper or uphole) main bowspring portion 80, whereas the second (e.g., lower or downhole) main bowspring portion 84 does not include a slot extending therethrough, but rather is a continuous piece of metallic material. In general, the slot 88 allows a flow of fluid to be received therethrough, which may be blocked or at least partially blocked from flowing past a lower (e.g., downhole) axial end of the multi-diameter thrust device 46 (e.g., when the fluid flows into an interior of the thrust cup 76) to generate thrust for the multi-diameter thrust device 46, as described in greater detail herein.

Returning to FIG. 5, in certain embodiments, a single thrust cup 76 may be sufficient to provide enough thrust to drive the multi-diameter thrust device 46 (and its associated downhole tool 12) downhole, but using multiple thrust cups 76 may add redundancy and reduce leakage past the thrust cups 76, for example, in situations where only relatively low pump rates are possible and/or when one of the thrust cups 76 is stopped in a connection where more leakage exists.

In addition, in the embodiment illustrated in FIG. 5, adjacent bowsprings 78 have alternating mounting heights (e.g., relative to the central axis 58 of the multi-diameter thrust device 46) such that the bowsprings 78 do not circumferentially interfere with each other. Rather, adjacent bowsprings 78 overlap (or underlap) each other when compressed (e.g., collapsed) radially. For example, when the multi-diameter thrust device 46 illustrated in FIG. 5 travels into a portion of a conduit (e.g., drill pipe 16) having a smaller ID, the adjacent bowsprings 78 move circumferentially relative to each other while still forming a relatively sealed OD to minimize leakage and to benefit from the deformation of the bowsprings 78 due to the inpinging flow of fluid to actually contact each other and create a seal, decreasing even further the leakage.

Figure 8:
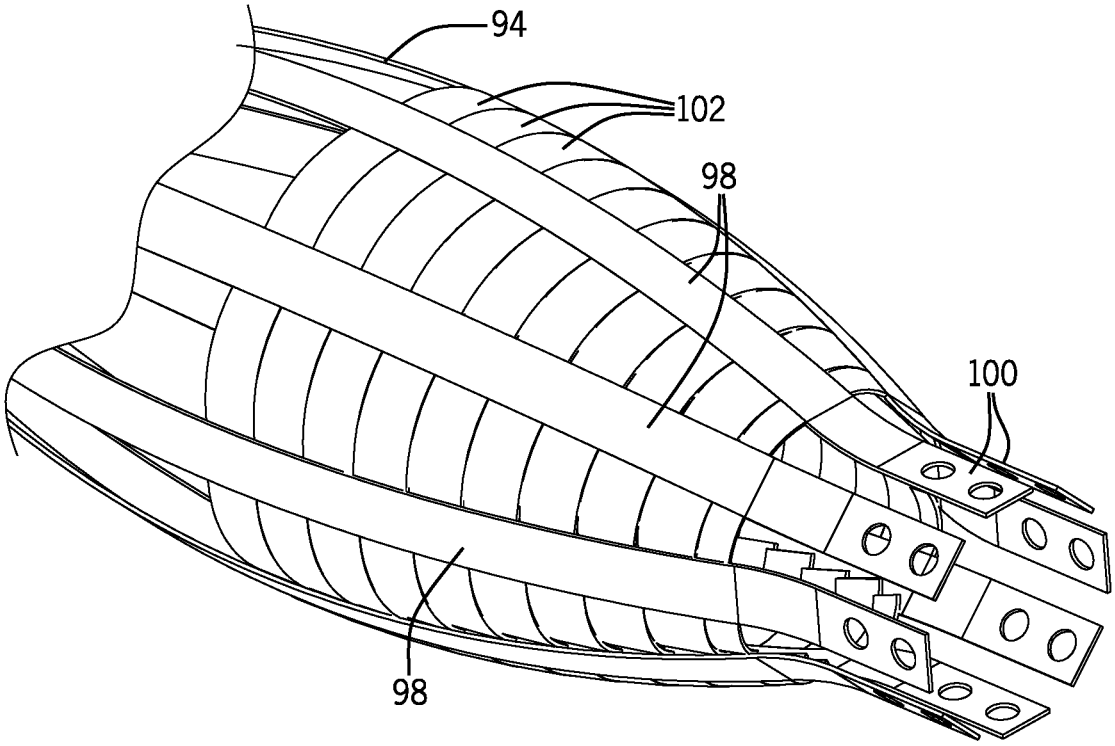
FIG. 8 is a perspective view of a portion of a thrust cup of the multi-diameter thrust device of FIG. 7, in accordance with embodiments of the present disclosure.
Figure 7:
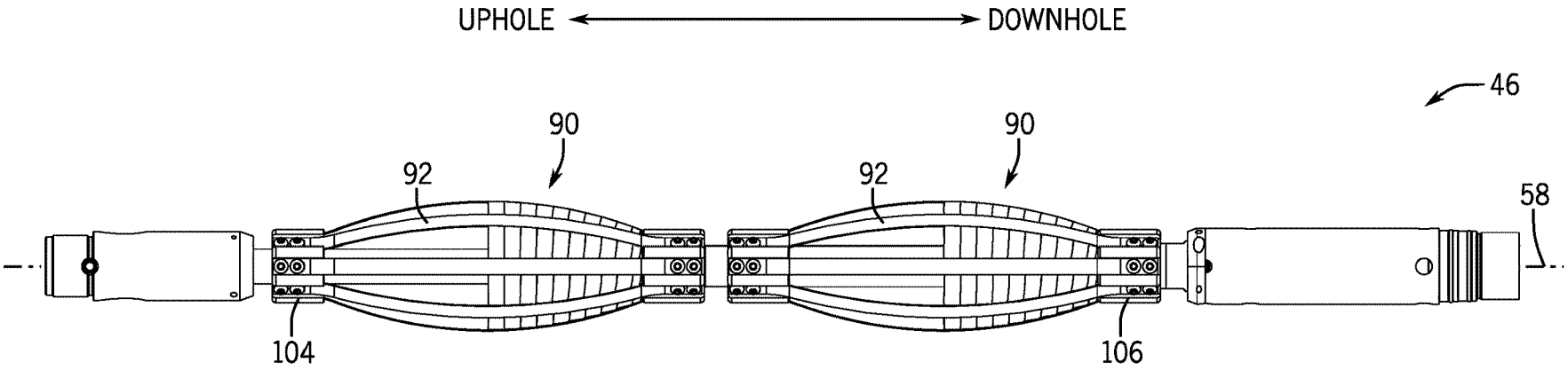
FIG. 7 is a side view of another embodiment of the multi-diameter thrust device, in accordance with embodiments of the present disclosure.
Figure 9:
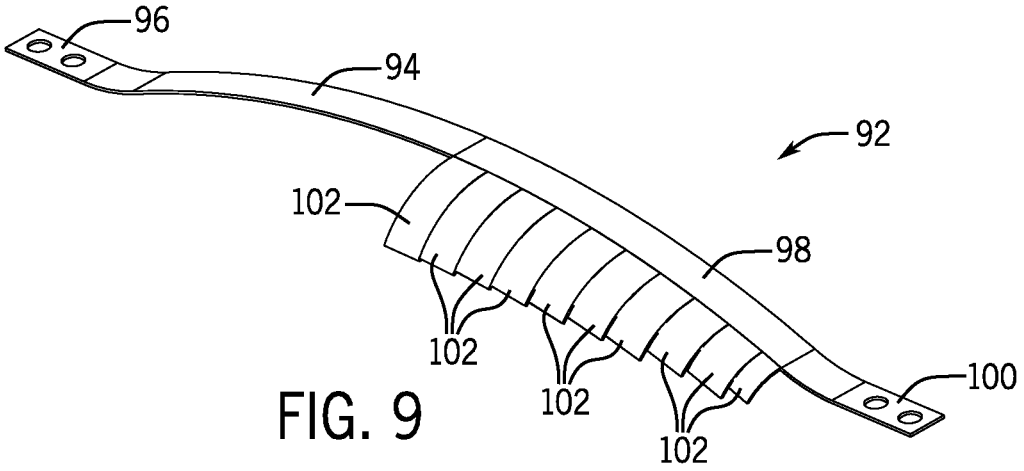
FIG. 9 is a perspective view of a bowspring and associated plurality of asymmetrical curved fingers of a thrust cup of the multi-diameter thrust device of FIG. 7, in accordance with embodiments of the present disclosure.
Figure 10:
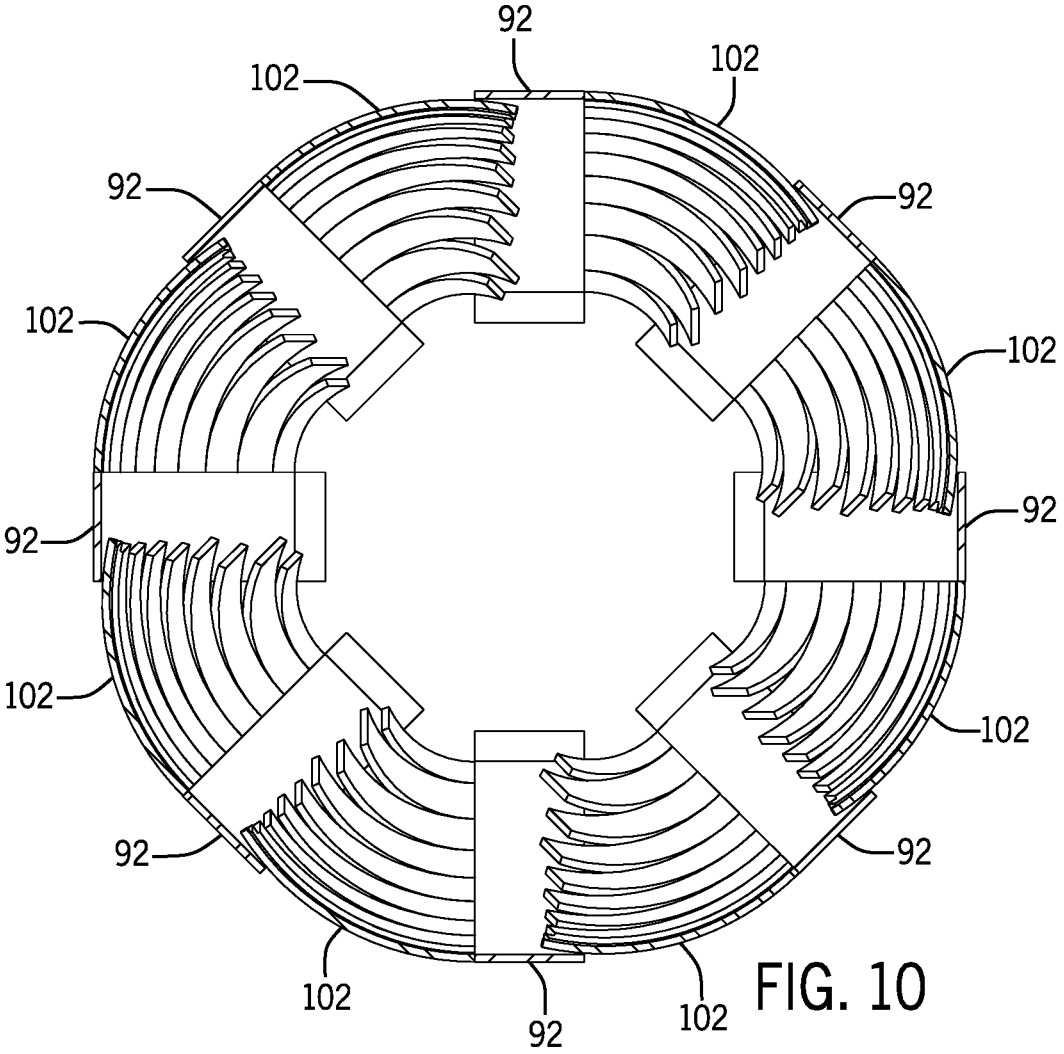
FIG. 10 is an end view a plurality of bowsprings and their associated pluralities of asymmetrical curved fingers of a thrust cup of the multi-diameter thrust device of FIG. 7, in accordance with embodiments of the present disclosure.

FIG. 7 is a side view of another embodiment of the multi-diameter thrust device 46 that includes a plurality of flexible metal thrust cups 90 disposed in series axially along the multi-diameter thrust device 46, each thrust cup 90 having a plurality of metal bowsprings 92. As illustrated in FIGS. 8-10 similar to the bowsprings 54, 78 described above, each bowspring 92 includes a first (e.g., upper or uphole) main bowspring portion 94 extending from a first (e.g., upper or uphole) axial end portion 96 of the bowspring 92 and a second (e.g., lower or downhole) main bowspring portion 98 extending from a second (e.g., lower or downhole) axial end portion 100 of the bowspring 92 that meet at an intermediate axial location along the multi-diameter thrust device 46. As also illustrated in FIGS. 8-10, all of the portions 94, 96, 98, 100 of each bowspring 92 form a continuous piece of metallic material that include a substantially constant width $w_1$ (e.g., within manufacturing tolerances, such as having less than 1% variance in width) along the entire axial length of the bowspring 92.

In addition, as also illustrated in FIGS. 8-10, the first (e.g., upper or uphole) main bowspring portions 94 of the bowsprings 92 are shaped such that they do not abut adjacent bowsprings 92 (e.g., are spaced circumferentially apart from adjacent bowsprings 92) when assembled together. In addition, while the second (e.g., lower or downhole) main bowspring portions 98 of the bowsprings 92 themselves are shaped such that they do not themselves abut adjacent bowsprings 92, each of the second (e.g., lower or downhole) main bowspring portions 98 of the bowsprings 92 is associated with a plurality of discrete (e.g., separate) asymmetrical curved fingers 102 that extend radially from second (e.g., lower or downhole) main bowspring portion 98 in the same radial direction (e.g., either clockwise or counterclockwise) relative to the central axis 58 of the multi-diameter thrust device 46 as all of the other asymmetrical curved fingers 102 of the thrust cup 90. In addition, the plurality of asymmetrical curved fingers 102 are adjacent each other along the axial length of the respective second (e.g., lower or downhole) main bowspring portion 98. In addition, as illustrated most clearly in FIG. 10, each of the asymmetrical curved fingers 102 are at least partially disposed radially within a respective second (e.g., lower or downhole) main bowspring portion 98 of a neighboring bowspring 92. In general, the circumferential space between first (e.g., upper or uphole) main bowspring portions 94 of the bowsprings 92 allow a flow of fluid to be received therethrough, which may be blocked or at least partially blocked from flowing past a lower (e.g., downhole) axial end of the multi-diameter thrust device 46 (e.g., when the fluid flows into an interior of the thrust cup 90) by the asymmetrical curved fingers 102 to generate thrust for the multi-diameter thrust device 46, as described in greater detail herein.

The asymmetrical curved fingers 102 are configured to increase the range of IDs that can be navigated without increasing leakage insofar as they curl down on only one lateral side of the respective bowspring 92, as illustrated by FIG. 9. As will be appreciated, each asymmetrical curved finger 102 is configured to move independently from the other asymmetrical curved fingers 102 of the respective bowspring 92, which allows the thrust cup 90 to be very flexible and maintain its shape without permanently deforming any of the bowsprings 92. In addition, the asymmetrical curved fingers 102 allow a far greater range of motion since each bowspring 92 holds the asymmetrical curved fingers 102 of its neighboring bowspring 92 (i.e., the other bowspring 92 that also contacts the asymmetrical curved fingers 102) in place. The curvature of the asymmetrical curved fingers 102 are forced by the neighboring bowspring 92 into a shape that closely matches the ID curvature of the conduit (e.g., drill pipe 16) through which the multi-diameter thrust device 46 travels. Because the asymmetrical curved fingers 102 slide radially within (i.e., rather than radially outside of) the neighboring bowspring 92, there is no risk of interference of neighboring bowsprings 92 of asymmetrical curved fingers 102, and there is also no risk of the edges of the asymmetrical curved fingers 102 getting caught on a relatively rough surface of the ID of the conduit (e.g., drill pipe 16) through which the multi-diameter thrust device 46 travels. In addition, due to the asymmetrical design of the curved fingers 102, portions of the thrust cup 90 with have a tendency to rotate slightly (e.g., such that the thrust cup 90 experiences slight torsion), which may provide a further benefit of reducing friction with the conduit (e.g., drill pipe 16) through which the multi-diameter thrust device 46 travels insofar as one end of the thrust cup 90 is allowed to rotate relative to the mandrel 74, as described in greater detail herein.

In general, the asymmetrical curved fingers 102 are long enough to be tucked under (e.g., radially within) the neighboring bowspring 92 when the multi-diameter thrust device 46 is assembled together in its relaxed state (e.g., before insertion into a conduit, which would cause compression of the bowsprings 92). As such, the fewer bowsprings 92 that are used, the longer the asymmetrical curved fingers 102 will need to be. In general, longer asymmetrical curved fingers 102 lead to more flexibility and lower internal stresses, while shorter asymmetrical curved fingers 102 lead to more stiffness and higher internal stresses. When considering how many individual asymmetrical curved fingers 102 to use on each bowspring 92, more (and narrower) asymmetrical curved fingers 102 lead to a more flexible design, but also lead to more leakage through gaps between the asymmetrical curved fingers 102. In certain embodiments, the asymmetrical curved fingers 102 may be narrower (e.g., have a smaller width $w_1$ near the second (e.g., lower or downhole) axial end portion 100 of the bowspring 92 than a width $w_2$ near the first (e.g., upper or uphole) axial end portion 96 of the bowspring 92 since the exposed length (i.e., before contacting the bottom of the neighboring bowspring 92) is less than the asymmetrical curved fingers 102 further back.

In certain embodiments, the asymmetrical curved fingers 102 may optionally be pre-bent before heat treatment to reduce the stresses experienced while flexing through the entire range of motion. In general, pre-bending adds complexity to the manufacturing process; however, changes in geometry (e.g., narrower asymmetrical curved fingers 102 or thinner base material) may be sufficient to keep material stresses in an acceptable range.

Returning to FIG. 7, similar to the thrust cup 76 described above, in certain embodiments, a single thrust cup 90 may be sufficient to provide enough thrust to drive the multi-diameter thrust device 46 (and its associated downhole tool 12) downhole, but using multiple thrust cups 90 may add redundancy and reduce leakage past the thrust cups 90, for example, in situations where only relatively low pump rates are possible and/or when one of the thrust cups 90 is stopped in a connection where more leakage exists.

Each of the thrust cups 56, 76, 90 described herein include bowsprings 54, 78, 92 that have sufficient bow height (e.g., maximum distance as measured from the central axis 58 of the multi-diameter thrust device 46) to match or slightly exceed the maximum ID of the conduit (e.g., drill pipe 16) through which the multi-diameter thrust device 46 travels. In addition, the bowsprings 54, 78, 92 have a width that is as narrow as possible to minimize leakage past the gap created by the top surface of the bowspring 54, 78, 92 and the curved surface of the surrounding conduit (e.g., drill pipe 16) through which the multi-diameter thrust device 46 travels.

Figure 11:
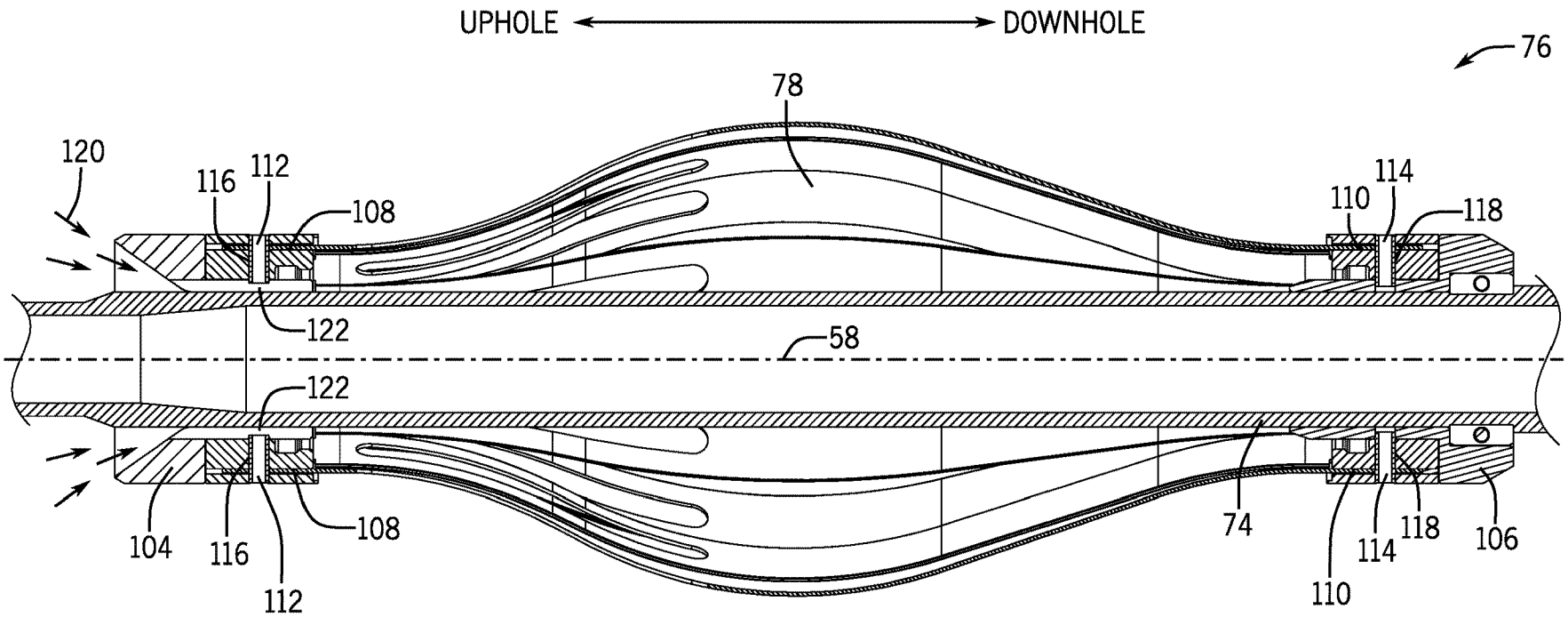
FIG. 11 is a cutaway side view of the thrust cup of FIG. 5, in accordance with embodiments of the present disclosure.

Regardless of the type of thrust cup 56, 76, 90, the bowsprings 54, 78, 92 may be mounted to the mandrel 74 using first and second axial end hubs 104, 106. For example, FIG. 11 is a cutaway side view of the thrust cup 76 of FIG. 5, illustrating how first (e.g., upper or uphole) axial end portions 82 of the bowsprings 78 may be coupled to a first (e.g., upper or uphole) axial end hub 104 and the second (e.g., lower or downhole) axial end portions 86 of the bowsprings 78 may be coupled to a second (e.g., upper or uphole) axial end hub 106. In particular, as illustrated, in certain embodiments, the axial end portions 82, 86 of the bowsprings 78 may be inserted into respective slots 108, 110 in the axial end hubs 104, 106 and secured in place by respective sets of fasteners 112, 114, which may be inserted through fastener holes 116, 118 through the axial end portions 82, 86. It will be appreciated that the bowsprings 54, 92 of the other thrust cups 56, 90 may be similarly coupled to the axial end hubs 104, 106.

As described in greater detail herein, in certain embodiments, the second (e.g., upper or uphole) axial end hub 106 may be secured to the mandrel 74 radially about the mandrel 74, whereas the first (e.g., upper or uphole) axial end hub 104 may be free to move (e.g., slide) axially relative to the mandrel 74 (e.g., by at least the amount needed to straighten out the bowsprings 78 when the multi-diameter thrust device 46 enters a minimum ID restriction of the conduit (e.g., drill pipe 16) through which the multi-diameter thrust device 46 travels. In addition, the first (e.g., upper or uphole) axial end hub 104 may also be free to rotate circumferentially about the mandrel 74, in certain embodiments (e.g., in the embodiment illustrated in FIG. 7-10).

Returning to FIG. 11, in certain embodiments, the first (e.g., upper or uphole) axial end hub 104 may be capable of receiving at least a portion of a flow of fluid 120 through a gap 122 formed between the first (e.g., upper or uphole) axial end hub 104 and the mandrel 74, whereas the second (e.g., upper or uphole) axial end hub 106 forms a seal against the mandrel 74 (e.g., to maximize pressure drop and thrust generated by the thrust cup 76) insofar as it is fixedly secured to the mandrel 74.

Figure 12:
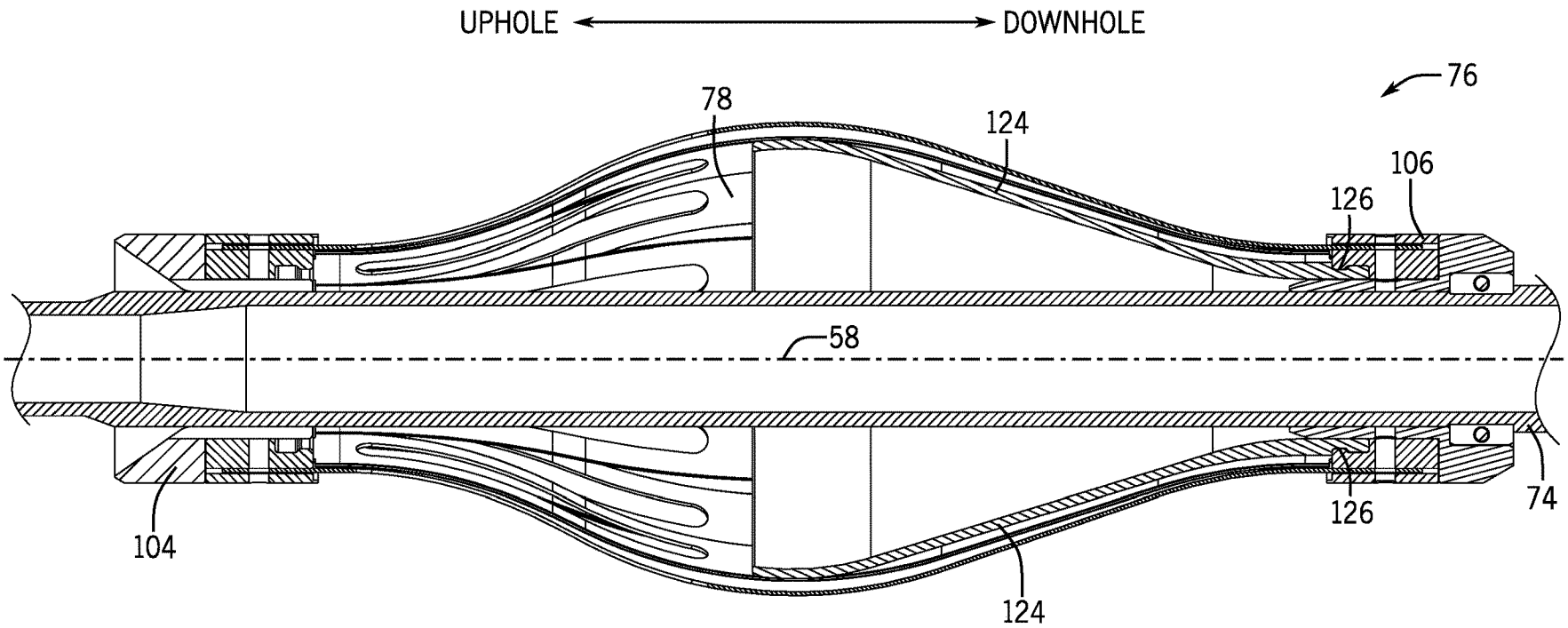
FIG. 12 is a cutaway side view of the thrust cup of FIG. 5, in accordance with embodiments of the present disclosure.
Figure 13:
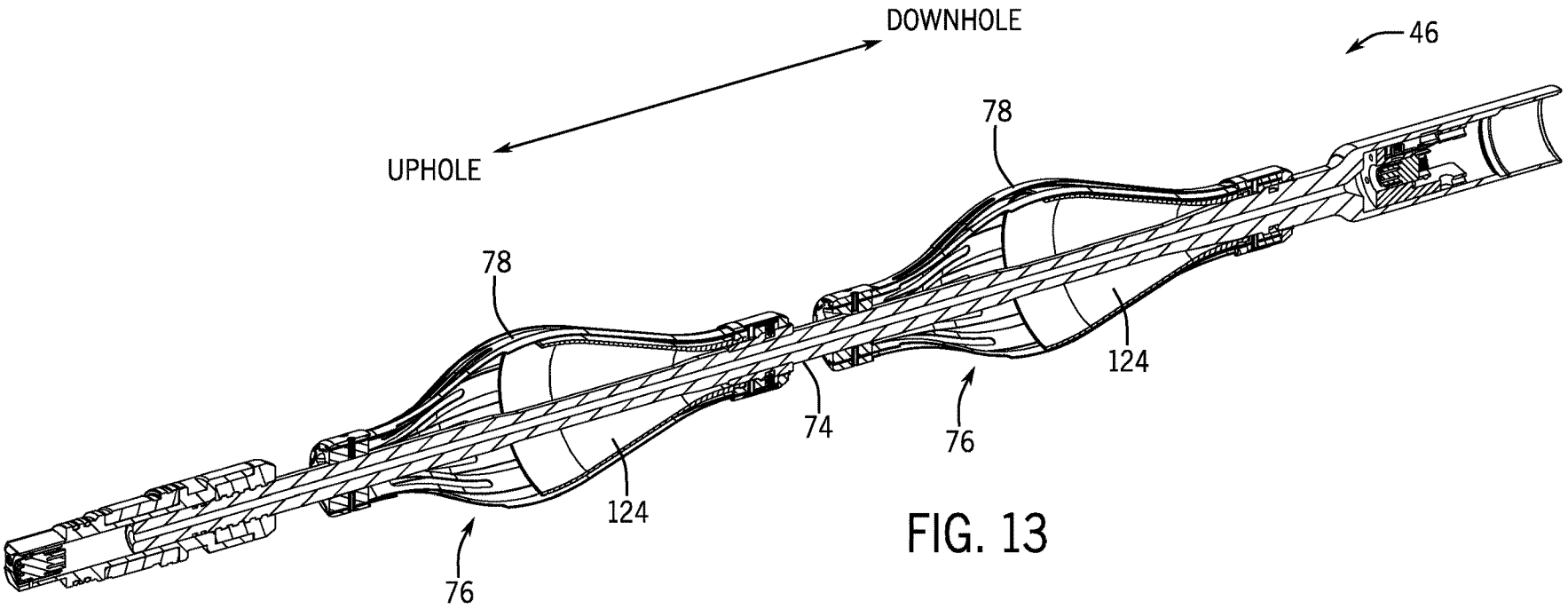
FIG. 13 is a perspective view of the thrust cup of FIG. 5, in accordance with embodiments of the present disclosure.

In addition, in certain embodiments, the thrust cups 56, 76, 90 may include an elastomeric bladder 124 even further reduce leakage through the thrust cup 56, 76, 90. FIGS. 12 and 13 are cutaway side and perspective views, respectively, of the thrust cup 76 of FIG. 5, illustrating how the bladder 124 may be disposed radially within the bowsprings 78 (e.g., radially within the second (e.g., lower or downhole) main bowspring portions 84 of the bowsprings 78. In addition, as illustrated most clearly in FIG. 12, in certain embodiments, the bladder 124 may be configured to be secured to the second (e.g., upper or uphole) axial end hub 106. For example, in certain embodiments, the bladder 124 may be held in place between the bowsprings 78 and the second (e.g., upper or uphole) axial end hub 106 by a lip 126 that extends from the second (e.g., upper or uphole) axial end hub 106 toward the bowsprings 78.

In certain embodiments, any combination and/or number of thrust cups 56, 76, 90 may be used as part of the multi-diameter thrust device 46. In addition, in certain embodiments, any combination and/or number of thrust cups 56, 76, 90 in addition to any combination and/or number of the thrust elements 48, 50 illustrated in FIG. 2 (e.g., in smaller ID restrictions) may be used as part of the multi-diameter thrust device 46.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

The invention claimed is:

1. A multi-diameter thrust device, comprising:

a mandrel;

one or more thrust cups secured to the mandrel radially about the mandrel, each thrust cup of the one or more thrust cups comprising:

a first axial end hub disposed at a first axial end of the thrust cup radially about the mandrel, wherein the first axial end hub of the thrust cup is configured to receive a flow of fluid through a gap formed between the first axial end hub and the mandrel;

a second axial end hub disposed at a second axial end of the thrust cup radially about the mandrel, wherein the first axial end and the second axial end are opposite axial ends of the thrust cup, and wherein the second axial end hub of the thrust cup is configured to at least partially block the fluid from flowing axially past the second axial end of the thrust cup; and a plurality of bowsprings, each bowspring of the plurality of bowsprings having a first axial end portion coupled to the first axial end hub and a second axial end portion coupled to the second axial end hub, wherein the plurality of bowsprings are disposed circumferentially about a central axis of the multi-diameter thrust device, and wherein each bowspring of the plurality of bowsprings of each thrust cup of the one or more thrust cups comprises:

a first main bowspring portion extending axially from the first axial end portion of the bowspring, wherein the first main bowspring portion is configured to be spaced circumferentially relative to the first main bowspring portions of adjacent bowsprings of the plurality of bowsprings; and a second main bowspring portion extending axially from the second axial end portion of the bowspring, wherein the first and second main bowspring portions meet at an intermediate axial location along the multi-diameter thrust device, and wherein the second main bowsprinq portion is associated with a plurality of discrete asymmetrical curved fingers extending radially from the second main bowspring portion and at least partially disposed radially within the second main bowspring portion of a neighboring bowspring adjacent each other along the axial length of the second main bowspring portion.

2. The multi-diameter thrust device of claim 1, wherein the mandrel is configured to be used as a housing or a flow line.

3. The multi-diameter thrust device of claim 1, wherein the second axial end hub of each thrust cup of the one or more thrust cups is secured to the mandrel radially about the mandrel.

4. The multi-diameter thrust device of claim 3, wherein the first axial end hub of each thrust cup of the one or more thrust cups is configured to slide axially relative to the mandrel.

5. The multi-diameter thrust device of claim 3, wherein the second axial end hub of each thrust cup of the one or more thrust cups forms a seal against the mandrel.

6. The multi-diameter thrust device of claim 1, wherein the plurality of bowsprings of each thrust cup of the one or more thrust cups are metal bowsprings.

7. The multi-diameter thrust device of claim 1, comprising a plurality of thrust cups disposed in series axially along the multi-diameter thrust device.

8. The multi-diameter thrust device of claim 1, wherein the plurality of bowsprings of each thrust cup of the one or more thrust cups are configured to collapse radially.

9. The multi-diameter thrust device of claim 1, wherein:

the first main bowspring portion of each bowspring is configured to be spaced circumferentially apart from the first main bowspring portions of adjacent bowsprings of the plurality of bowsprings; and the second main bowspring portion of each bowspring is configured to contact second main bowspring portions of adjacent bowsprings of the plurality of bowsprings.

10. The multi-diameter thrust device of claim 1, wherein:

the first main bowspring portion of each bowspring comprises a slot extending therethrough axially along the first main bowspring portion; and the second main bowspring portion of each bowspring does not comprise a slot extending therethrough.

11. The multi-diameter thrust device of claim 1, wherein each thrust cup of the one or more thrust cups comprises a bladder disposed radially within the plurality of bowsprings of the thrust cup.

12. The multi-diameter thrust device of claim 1, comprising one or more elastomeric swab cups disposed axially relative to the one or more thrust cups along the central axis of the multi-diameter thrust device.

13. A multi-diameter thrust device, comprising:

a mandrel configured to be used as a housing or a flow line; and one or more thrust cups secured to the mandrel radially about the mandrel, each thrust cup of the one or more thrust cups comprising:

a first axial end hub disposed at a first axial end of the thrust cup radially about the mandrel, wherein the first axial end hub is configured to slide axially relative to the mandrel, and wherein the first axial end hub is configured to receive a flow of fluid through a gap formed between the first axial end hub and the mandrel;

a second axial end hub secured to the mandrel at a second axial end of the thrust cup radially about the mandrel, wherein the first axial end and the second axial end are opposite axial ends of the thrust cup, and wherein the second axial end hub of the thrust cup is configured to at least partially block the fluid from flowing axially past the second axial end of the thrust cup; and a plurality of bowsprings configured to collapse radially, each bowspring of the plurality of bowsprings having a first axial end portion coupled to the first axial end hub and a second axial end portion coupled to the second axial end hub, wherein the plurality of bowsprings are disposed circumferentially about a central axis of the multi-diameter thrust device; and wherein each bowspring of the plurality of bowsprings comprises:

a first main bowspring portion extending axially from the first axial end portion of the bowspring, wherein the first main bowspring portion comprises a slot extending therethrough axially along the first main bowspring portion;

a second main bowspring portion extending axially from the second axial end portion of the bowspring, wherein the first and second main bowspring portions meet at an intermediate axial location along the multi-diameter thrust device, and wherein the second main bowspring portion does not comprise a slot extending therethrough; and wherein each thrust cup of the one or more thrust cups is configured to receive a flow of fluid at the first axial end of the thrust cup, and to at least partially block the fluid from flowing axially past the second axial end of the thrust cup.

14. The multi-diameter thrust device of claim 13 wherein the plurality of bowsprings of each thrust cup of the one or more thrust cups are metal bowsprings.

15. The multi-diameter thrust device of claim 13, comprising a plurality of thrust cups disposed in series axially along the multi-diameter thrust device.

16. A multi-diameter thrust device, comprising:

a mandrel configured to be used as a housing or a flow line; and one or more thrust cups secured to the mandrel radially about the mandrel, each thrust cup of the one or more thrust cups comprising:

a first axial end hub disposed at a first axial end of the thrust cup radially about the mandrel, wherein the first axial end hub is configured to slide axially relative to the mandrel, and wherein the first axial end hub is configured to receive a flow of fluid through a gap formed between the first axial end hub and the mandrel;

a second axial end hub secured to the mandrel at a second axial end of the thrust cup radially about the mandrel, wherein the first axial end and the second axial end are opposite axial ends of the thrust cup, and wherein the second axial end hub of the thrust cup is configured to at least partially block the fluid from flowing axially past the second axial end of the thrust cup; and a plurality of bowsprings configured to collapse radially, each bowspring of the plurality of bowsprings having a first axial end portion coupled to the first axial end hub and a second axial end portion coupled to the second axial end hub, wherein the plurality of bowsprings are disposed circumferentially about a central axis of the multi-diameter thrust device; and wherein each bowspring of the plurality of bowsprings comprises:

a first main bowspring portion extending axially from the first axial end portion of the bowspring, wherein the first main bowspring portion is configured to be spaced circumferentially relative to first main bowspring portions of adjacent bowsprings of the plurality of bowsprings; and a second main bowspring portion extending axially from the second axial end portion of the bowspring, wherein the first and second main bowspring portions meet at an intermediate axial location along the multi-diameter thrust device, and wherein the second main bowspring portion is associated with a plurality of discrete asymmetrical curved fingers extending radially from the second main bowspring portion and at least partially disposed radially within the second main bowspring portion of a neighboring bowspring adjacent each other along the axial length of the second main bowspring portion; and a plurality of discrete asymmetrical curved fingers extending radially from the second main bowspring portion and at least partially disposed radially within the second main bowspring portion of a neighboring bowspring adjacent each other along the axial length of the second main bowspring portion; and wherein each thrust cup of the one or more thrust cups is configured to receive a flow of fluid at the first axial end of the thrust cup, and to at least partially block the fluid from flowing axially past the second axial end of the thrust cup.

17. The multi-diameter thrust device of claim 16, wherein the plurality of bowsprings of each thrust cup of the one or more thrust cups are metal bowsprings.

18. The multi-diameter thrust device of claim 16, comprising a plurality of thrust cups disposed in series axially along the multi-diameter thrust device.

* * * * *